US010559159B2

(12) United States Patent
Post

(10) Patent No.: US 10,559,159 B2
(45) Date of Patent: Feb. 11, 2020

(54) GESTURE-BASED NAVIGATION ON GAMING TERMINAL WITH 3D DISPLAY

(71) Applicant: IGT CANADA SOLUTIONS ULC, Moncton (CA)

(72) Inventor: Peter John Post, Lieboch (AT)

(73) Assignee: IGT CANADA SOLUTIONS ULC, Moncton (CA)

( * ) Notice: Subject to any disclaimer, the term of this patent is extended or adjusted under 35 U.S.C. 154(b) by 312 days.

(21) Appl. No.: 14/861,268

(22) Filed: Sep. 22, 2015

(65) Prior Publication Data

US 2016/0189469 A1 Jun. 30, 2016

Related U.S. Application Data

(60) Provisional application No. 62/053,429, filed on Sep. 22, 2014.

(51) Int. Cl.
*G07F 17/32* (2006.01)

(52) U.S. Cl.
CPC ..... *G07F 17/3211* (2013.01)

(58) Field of Classification Search
CPC ..... G07F 17/3211; G07F 17/3239
USPC ..... 463/32
See application file for complete search history.

(56) References Cited

U.S. PATENT DOCUMENTS 6,222,465 B1 4/2001 Kumar et al.
7,445,549 B1 * 11/2008 Best ..... A63F 13/10 463/30
7,815,507 B2 10/2010 Parrott et al.
2010/0234094 A1 * 9/2010 Gagner ..... G07F 17/32 463/20
2011/0306416 A1 * 12/2011 Kelly ..... G07F 17/32 463/31

* cited by examiner

*Primary Examiner* — Omkar A Deodhar
*Assistant Examiner* — Wei Lee
(74) *Attorney, Agent, or Firm* — Sage Patent Group

(57) ABSTRACT

An electronic gaming machine for providing a game to a player includes a camera configured to generate camera data. The electronic gaming machine further includes a display configured to provide auto stereoscopic 3D viewing of at least a portion of the game and a processor coupled with the display and the camera. The processor is configured to: determine a location of the player relative to the electronic gaming machine from camera data; adjust the display based on the determined location of the player to provide auto stereoscopic three dimensional viewing by the player; responsive to movement of the player indicated by the camera data, update the display to account for a change in location of the player; and determine that the movement of the player corresponds to a predetermined gesture and, in response, update a game state of the game based on the predetermined gesture.

13 Claims, 5 Drawing Sheets

GESTURE-BASED NAVIGATION ON GAMING TERMINAL WITH 3D DISPLAY

TECHNICAL FIELD

The present disclosure relates generally to electronic gaming systems, such as casino gaming terminals. More specifically, the present disclosure relates to methods and systems for controlling electronic gaming systems.

BACKGROUND

Gaming terminals and systems, such as casino-based gaming terminals, often include a variety of physical input mechanisms which allow a player to input instructions to the gaming terminal. For example, slot machines are often equipped with a lever which causes the machine to initiate a spin when engaged.

BRIEF DESCRIPTION OF THE DRAWINGS

Reference will now be made, by way of example, to the accompanying drawings which show an embodiment of the present application, and in which.

Similar reference numerals are used in different figures to denote similar components.

DETAILED DESCRIPTION OF EXAMPLE EMBODIMENTS

Figure 1:
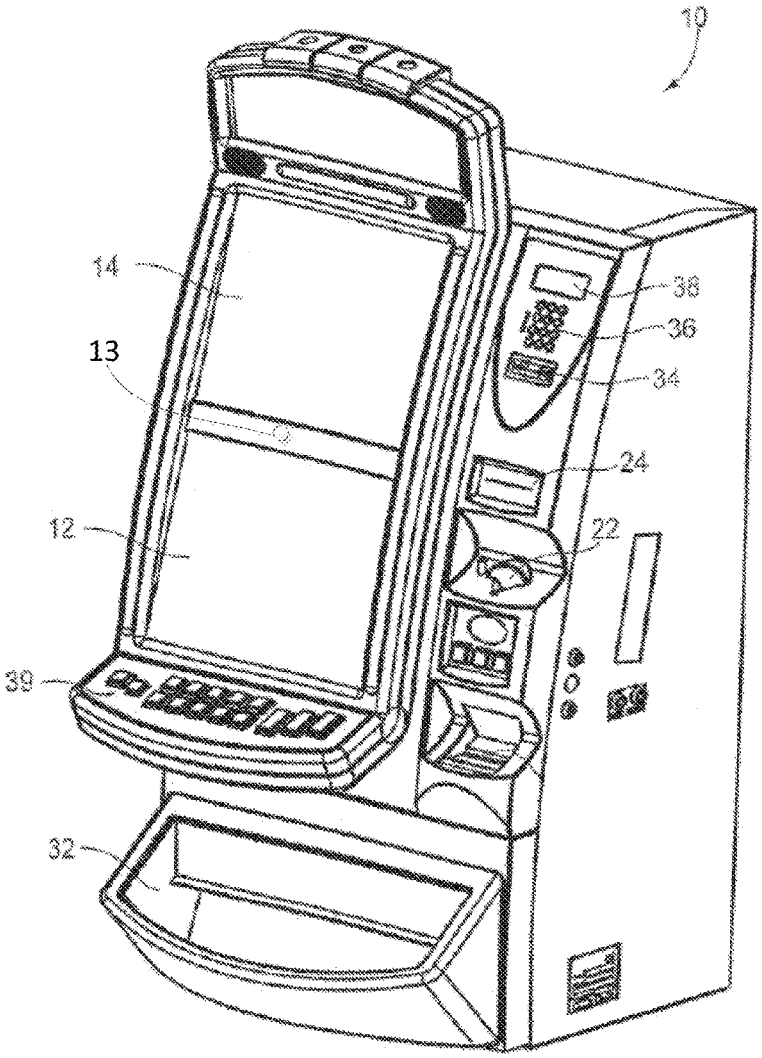
FIG. 1 shows an example electronic gaming system (EGM) in accordance with example embodiments of the present disclosure.

There is described systems, devices and methods that allow for three-dimensional game play without the use of special glasses or goggles and which allow for navigational input commands to be received using contactless gestures.

In one aspect, an electronic gaming machine for providing a game to a player is described. The electronic gaming machine includes a camera oriented to capture movement of a player of the game. The camera is configured to generate camera data. The electronic gaming machine further comprises a display configured to provide auto stereoscopic three dimensional viewing of at least a portion of the game and at least one processor coupled with the display and the camera. The at least one processor is configured to: determine a location of the player relative to the electronic gaming machine from camera data; adjust the display based on the determined location of the player to provide auto stereoscopic three dimensional viewing by the player; responsive to movement of the player indicated by the camera data, update the display to account for a change in location of the player; and determine that the movement of the player corresponds to a predetermined gesture and, in response, update a game state of the game based on the predetermined gesture.

In another aspect, a computer implemented method is described. The method includes: determining a location of a player relative to an electronic gaming machine from camera data generated by a camera; adjusting a display based on the determined location of the player to provide auto stereoscopic three dimensional viewing by the player; responsive to movement of the player indicated by the camera data, updating the display to account for a change in location of the player; and determining that the movement of the player corresponds to a predetermined gesture and, in response, updating a game state of the game based on the predetermined gesture.

In yet another embodiment, a non-transitory computer readable medium is described. The computer readable medium includes computer-executable instructions including: instructions for determining a location of a player relative to an electronic gaming machine from camera data generated by a camera; instructions for adjusting a display based on the determined location of the player to provide auto stereoscopic three dimensional viewing by the player; instructions for responsive to movement of the player indicated by the camera data, updating the display to account for a change in location of the player; and instructions for determining that the movement of the player corresponds to a predetermined gesture and, in response, updating a game state of the game based on the predetermined gesture.

Other aspects and features of the present application will become apparent to those ordinarily skilled in the art upon review of the following description of specific embodiments of the application in conjunction with the accompanying figures.

In at least some embodiments, the gaming improvements described herein may be included in an Electronic Gaming Machine (EGM). An example EGM 10 is illustrated in FIG. 1.

The example EGM 10 of FIG. 1 is shown in perspective view. The example EGM 10 is configured to provide a three-dimensional viewing mode in which contactless gestures may be input to the EGM 10 through body gestures of a user.

The EGM 10 includes a primary display 12. The primary display 12 may be of a variety of different types including, for example, a thin film transistor (TFT) display, a liquid crystal display (LCD), a cathode ray tube (CRT), a light emitting diode (LED) display, an organic light emitting diode (OLED) display, or a display of another type.

In an embodiment, the display 12 is a three-dimensional (3D) display which may be operated in a 3D mode. More particularly, the display 12 may be configured to provide an illusion of depth by projecting separate visual information for a left eye and for a right eye of a user. The display 12 may be an auto stereoscopic display. An auto stereoscopic display is a display that does not require special glasses to be worn. That is, the 3D effect is provided by the display itself, without the need for headgear, such as glasses. In such embodiments, the display 12 is configured to provide separate visual information to each of a user's eyes. This separation is, in some embodiments, accomplished with a parallax barrier or lenticular technology.

Accordingly, the auto stereoscopic display may use lenticular technology to provide a 3D stereoscopic effect. The auto stereoscopic display may include a lenticular screen mounted on a conventional display, such as an LCD. The images may be directed to a viewer's eyes by switching LCD subpixels.

The EGM 10 includes a camera 13 which is generally oriented in the direction of a user of the EGM 10. For example, the camera 13 may be directed so that a head of a user of the EGM 10 will generally be visible by the camera 13 while that user is operating the EGM 10. The camera 13 may be a digital camera that has an image sensor that generates an electrical signal based on received light. This electrical signal represents camera data and the camera data may be stored in memory of the EGM in any suitable image or video file format. The camera 13 may be a stereo camera which includes two image sensors (i.e. the camera 13 may include two digital cameras). These image sensors may be mounted in spaced relation to one another. The use of multiple cameras allows multiple images of a user to be obtained at the same time. That is, the cameras can generate stereoscopic images and these stereoscopic images allow depth information to be obtained. For example, the EGM 10 may be configured to determine a location of a user relative to the EGM 10 based on the camera data (i.e. based on data generated by the camera 13). In at least some embodiments, the user location information may be determined at a player locating subsystem coupled to the camera 13.

The player locating subsystem may obtain player location information such as the depth of a user (i.e. distance between the user and the EGM 10) and lateral location information representing the later location of a user's eyes relative to the EGM 10. Thus, from the camera data the EGM 10 may determine the location of the user in a three dimensional space (e.g., X, Y, and Z coordinates representing the location of a user's eyes relative to the EGM may be obtained). In some embodiments, the location of each of a user's eyes in three dimensional space may be obtained (e.g, X, Y and Z coordinates may be obtained for a right eye and X, Y and Z coordinates may be obtained for a left eye). Accordingly, the camera 13 may be used for eye-tracking.

As illustrated in FIG. 1, in some embodiments, the camera 13 may be mounted immediately above the display 12, midway between left and right ends of the display.

The EGM 10 may include a video controller that controls the display 12. The video controller may control the display 12 based on camera data. More particularly, the location of the user relative to the EGM 10 may be used, by the video controller, to control the display 12 and ensure that the correct data is projected to the left eye and to the right eye. In this way, the video controller adjusts the display based on the eye tracking performed on camera data received from the camera—the camera tracks the position of the user's eyes to guide a software module which performs the switching for the display.

The EGM 10 of FIG. 1 also includes a second display 14. The second display provides game data or other information in addition to the display 12. The second display 14 may provide static information, such as an advertisement for the game, the rules of the game, pay tables, pay lines, or other information, or may even display the main game or a bonus game along with the display 12. The second display 14 may utilize any of the display technologies noted above (e.g., LED, OLED, CRT, etc.) and may also be an auto stereoscopic display. In such embodiments, the second display 14 may be equipped with a secondary camera (which may be a stereo camera) for tracking the location of a user's eyes relative to the second display 14. In some embodiments, the second display may not be an electronic display; instead, it may be a display glass for conveying information about the game.

The EGM 10 is equipped with one or more input mechanisms. For example, in some embodiments, one or both of the displays 12 and 14 may be a touchscreen which includes a touchscreen layer, such as a touchscreen overlay. The touchscreen layer is touch-sensitive such that an electrical signal is produced in response to a touch. The electrical signal allows the location of the touch (e.g., X-Y coordinates) to be determined. In an embodiment, the touchscreen is a capacitive touchscreen which includes a transparent grid of conductors. Touching the screen causes a change in the capacitance between conductors, which allows the location of the touch to be determined. The touchscreen may be configured for multi-touch.

Other input mechanisms may be provided instead of or in addition to the touchscreen. For example, a keypad 36 may accept player input, such as a personal identification number (PIN) or any other player information. A display 38 above keypad 36 displays a menu for instructions and other information and provides visual feedback of the keys pressed. The keypad 36 may be an input device such as a touchscreen, or dynamic digital button panel, in accordance with some embodiments.

Control buttons 39 may also act as an input mechanism and be included in the EGM. The control buttons 39 may include buttons for inputting various input commonly associated with a game provided by the EGM 10. For example, the control buttons 39 may include a bet button, a repeat bet button, a spin reels (or play) button, a maximum bet button, a cash-out button, a display pay lines button, a display payout tables button, select icon buttons, or other buttons. In some embodiments, one or more of the control buttons may be virtual buttons which are provided by a touchscreen.

The EGM 10 may also include currency, credit or token handling mechanisms for receiving currency, credits or token required for game play or for dispensing currency, credits or tokens based on the outcome of the game play. A coin slot 22 may accept coins or tokens in one or more denominations to generate credits within EGM 10 for playing games. An input slot 24 for an optical reader and printer receives machine readable printed tickets and outputs printed tickets for use in cashless gaming.

A coin tray 32 may receive coins or tokens from a hopper upon a win or upon the player cashing out. However, the EGM 10 may be a gaming terminal that does not pay in cash but only issues a printed ticket which is not legal tender. Rather, the printed ticket may be converted to legal tender elsewhere.

In some embodiments, a card reader interface 34, such as a card reader slot, may allow the EGM 10 to interact with a stored value card, identification card, or a card of another type. A stored value card is a card which stores a balance of credits, currency or tokens associated with that card. An identification card is a card that identifies a user. In some cases, the functions of the stored value card and identification card may be provided on a common card. However, in other embodiments, these functions may not be provided on the same card. For example, in some embodiments, an identification card may be used which allows the EGM 10 to identify an account associated with a user. The identification card uniquely identifies the user and this identifying information may be used, for example, to track the amount of play associated with the user (e.g., in order to offer the user promotions when their play reaches certain levels). The identification card may be referred to as a player tracking card. In some embodiments, an identification card may be inserted to allow the EGM 10 to access an account balance associated with the user's account. The account balance may be maintained at a host system or other remote server accessible to the EGM 10 and the EGM 10 may adjust the balance based on game play on the EGM 10. In embodiments in which a stored value card is used, a balance may be stored on the card itself and the balance may be adjusted to include additional credits when a winning outcome results from game play.

The stored value card and/or identification card may include a memory and a communication interface which allows the EGM 10 to access the memory of the stored value card. The card may take various forms including, for example, a smart card, a magnetic strip card (in which case the memory and the communication interface may both be provided by a magnetic strip), a card with a bar code printed thereon, or another type of card conveying machine readable information. In some embodiments, the card may not be in the shape of a card. Instead, the card may be provided in another form factor. For example, in some embodiments, the card may be a virtual card residing on a mobile device such as a smartphone. The mobile device may, for example, be configured to communicate with the EGM 10 via a near field communication (NFC) subsystem.

The nature of the card reader interface 34 will depend on the nature of the cards which it is intended to interact with. The card reader interface may, for example, be configured to read a magnetic code on the stored value card, interact with pins or pads associated with the card (e.g., if the card is a smart card), read a bar code or other visible indicia printed on the card (in which case the card reader interface 34 may be an optical reader), or interact with the card wirelessly (e.g., if it is NFC enabled). In some embodiments, the card is inserted into the card reader interface 34 in order to trigger the reading of the card. In other embodiments, such as in the case of NFC enabled cards, the reading of the card may be performed without requiring insertion of the card into the card reader interface 34.

As noted above, the EGM 10 may include a camera 13 which is used to track a user's eyes to provide an auto stereoscopic operating mode. The camera 13 may also be used to track a user's eyes or head in order to allow the user to input a contactless gesture to the EGM 10. For example, a first gesture may involve a user moving their head to the left (e.g. from right to left) and another gesture may involve a user moving their head to the right (e.g. from right to left). The movement corresponding to the gesture is, in some embodiments, a lateral movement. That is, a user may shift either left or right while their eyes remain generally horizontal. In some embodiments, the movement corresponding to the gesture is a tilt of the head. The user may tilt their head left or right so that their eyes are no longer horizontal and this may be interpreted as a gesture by the EGM. Another gesture, which may be referred to as an upward tilt gesture, may require a user to raise their head from a resting position in which the user's face is generally forward-facing, to a position in which their face is directed upwardly, e.g., towards the sky or ceiling. A downward tilt gesture may be performed by moving from the resting position to a position in which the user's face is directed downward, e.g., towards the floor. Other gestures apart from those noted above may be used in other embodiments.

In some embodiments, the EGM 10 processes camera data from the camera (which may be a stereo camera) to determine whether a gesture has been performed. As noted above in the discussion of auto stereoscopy, the EGM 10 may include a player locating subsystem, which tracks the location of a user (or features of the user such as their eyes) relative to the EGM 10. The player locating subsystem may include eye-tracking and/or head tracking subsystems which track movements of a user's eyes and/or head. The output of the player locating subsystem may be used by the EGM 10 to determine whether a gesture has been performed.

Each gesture that the EGM 10 is configured to detect is associated with a separate input command and the EGM 10 may operate differently based on the input command received. Accordingly, the gesture recognition functionalities provide the EGM with a further input mechanism.

In an operating mode, a detected gesture provides the EGM 10 with a player decision. The player decision is, in at least some embodiments, a binary decision having two possible options. For example, in an operating mode, a user may elect to move either left or right within a virtual environment provided by a game operating on the EGM 10 and a gesture may be used to indicate a user's desired direction of travel. For example, a left gesture (e.g. a movement or tilt of the head in the left direction) may be interpreted as an input command instructing the EGM 10 to move left within the virtual environment. In contrast, a right gesture (e.g. a movement or tilt of the head in the right direction) may be interpreted as an input command instructing the EGM 10 to move right within the virtual environment. While the gesture is being performed the auto stereoscopic functions of the EGM 10 discussed above may continually account for the change in the location of the user's eyes to ensure that the user continues to view the display 12 in 3D. That is, adjustments may be made to the auto stereoscopic display 12 to account for the user's change in eye location.

The EGM 10 may include other output interfaces in addition to the display 12 and the second display 14. For example, the EGM 10 may include one or more speakers, lights, vibratory output devices, etc.

While not illustrated in FIG. 1, the EGM 10 may include a chair or seat. The chair or seat may be fixed to the EGM 10 so that the chair or seat does not move relative to the EGM 10. This fixed connection maintains the user in a position which is generally centrally aligned with the display 12 and the camera. This position ensures that the camera detects the user and provides consistent experiences between users.

The embodiments described herein are implemented by physical computer hardware embodiments. The embodiments described herein provide useful physical machines and particularly configured computer hardware arrangements of computing devices, servers, electronic gaming terminals, processors, memory, networks, for example. The embodiments described herein, for example, is directed to computer apparatuses, and methods implemented by computers through the processing of electronic data signals.

Accordingly, the EGM 10 is particularly configured for moving game components. The display screens 12, 14 may display via a user interface three-dimensional game components of a game in accordance with a set of game rules using game data, stored in a data storage device.

The embodiments described herein involve numerous hardware components such as an EGM 10, computing devices, cameras, servers, receivers, transmitters, processors, memory, a display, networks, and electronic gaming terminals. These components and combinations thereof may be configured to perform the various functions described herein, including the auto stereoscopy functions and the gesture recognition functions. Accordingly, the embodiments described herein are directed towards electronic machines that are configured to process and transform electromagnetic signals representing various types of information. The embodiments described herein pervasively and integrally relate to machines, and their uses; and the embodiments described herein have no meaning or practical applicability outside their use with computer hardware, machines, a various hardware components.

Substituting the EGM 10, computing devices, cameras, servers, receivers, transmitters, processors, memory, a display, networks, and electronic gaming terminals for non-physical hardware, using mental steps for example, substantially affects the way the embodiments work.

Such computer hardware features are clearly essential elements of the embodiments described herein, and they cannot be omitted or substituted for mental means without having a material effect on the operation and structure of the embodiments described herein. The computer hardware is essential to the embodiments described herein and is not merely used to perform steps expeditiously and in an efficient manner.

Figure 2:
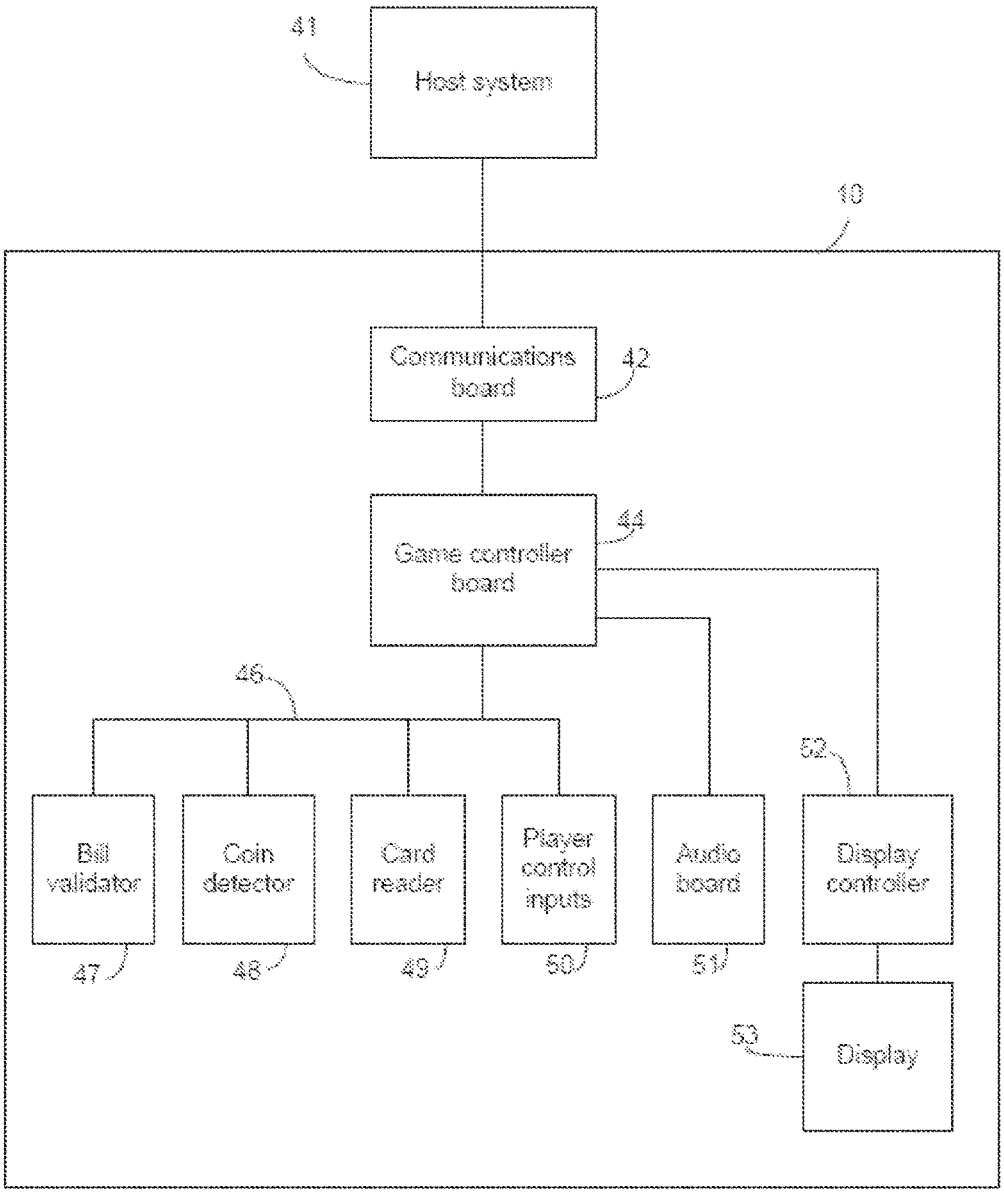
FIG. 2 shows a block diagram of an EGM in accordance with an embodiment of the present disclosure.

Reference will now be made to FIG. 2 which illustrates a block diagram of an EGM 10, which may be an EGM of the type described above with reference to FIG. 1.

The example EGM 10 is linked to a casino's host system 41. The host system 41 may provide the EGM 10 with instructions for carrying out game routines. The host system 41 may also manage a player account and may adjust a balance associated with the player account based on game play at the EGM 10.

The EGM 10 includes a communications board 42 which may contain conventional circuitry for coupling the EGM to a local area network (LAN) or another type of network using any suitable protocol, such as the Game to System (G2S) standard protocol. The communications board 42 may allow the EGM 10 to communicate with the host system 41 to enable software download from the host system 41, remote configuration of the EGM 10, remote software verification, and/or other features. The G2S protocol document is available from the Gaming Standards Association and this document is incorporated herein by reference.

The communications board 42 transmits and receives data using a wireless transmitter, or it may be directly connected to a network running throughout the casino floor. The communications board 42 establishes a communication link with a master controller and buffers data between the network and a game controller board 44. The communications board 42 may also communicate with a network server, such as the host system 41, for exchanging information to carry out embodiments described herein.

The communications board 42 is coupled to a game controller board 44. The game controller board 44 contains memory and a processor for carrying out programs stored in the memory and for providing the information requested by the network. The game controller board 44 primarily carries out the game routines.

Peripheral devices/boards communicate with the game controller board 44 via a bus 46 using, for example, an RS-232 interface. Such peripherals may include a bill validator 47, a coin detector 48, a card reader interface such as a smart card reader or other type of card reader 49, and player control inputs 50 (such as buttons or a touch screen). Other peripherals may include one or more cameras used for eye and/or head tracking of a user to provide the auto stereoscopic functions and contactless gesture recognition function described herein.

The game controller board 44 may also control one or more devices that produce the game output including audio and video output associated with a particular game that is presented to the user. For example an audio board 51 may convert coded signals into analog signals for driving speakers. A display controller 52, which typically requires a high data transfer rate, may convert coded signals to pixel signals for the display 53. The display controller 52 and audio board 51 may be directly connected to parallel ports on the game controller board 44. The electronics on the various boards may be combined onto a single board.

Figure 3:
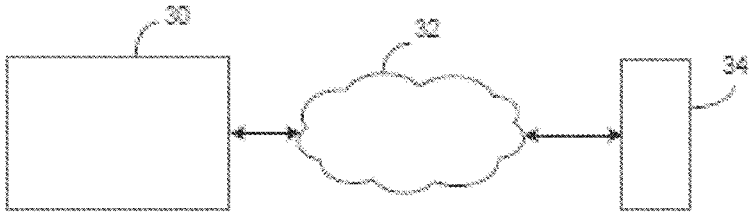
FIG. 3 is an example online implementation of a computer system configured for gaming.

FIG. 3 illustrates an example online implementation of a computer system and online gaming device in accordance with the present gaming enhancements. For example, a server computer 34 may be configured to enable online gaming in accordance with embodiments described herein. Accordingly, the server computer 34 and/or a computing device 30 (which may be coupled to the server computer 34) may perform one or more functions of the EGM 10 described herein.

One or more users may use a computing device 30 that is configured to connect to the Internet 32 (or other network), and via the Internet 32 to the server computer 34 in order to access the functionality described in this disclosure. The server computer 34 may include a movement recognition engine that may be used to process and interpret collected player movement data, to transform the data into data defining manipulations of game components or view changes.

Computing device 30 may be configured with hardware and software to interact with an EGM 10 or gaming server 34 via network 32 to implement gaming functionality and render three dimensional enhancements, as described herein. For simplicity only one computing device 30 is shown but system may include one or more computing devices 30 operable by users to access remote network resources. The computing device 30 may be implemented using one or more processors and one or more data storage devices configured with database(s) or file system(s), or using multiple devices or groups of storage devices distributed over a wide geographic area and connected via a network (which may be referred to as "cloud computing").

The computing device 30 may reside on any networked computing device, such as a personal computer, workstation, server, portable computer, mobile device, personal digital assistant, laptop, tablet, smart phone, WAP phone, an interactive television, video display terminals, gaming consoles, electronic reading device, and portable electronic devices or a combination of these.

The computing device 30 may include any type of processor, such as, for example, any type of general-purpose microprocessor or microcontroller, a digital signal processing (DSP) processor, an integrated circuit, a field programmable gate array (FPGA), a reconfigurable processor, a programmable read-only memory (PROM), or any combination thereof. Computing device 30 may include any type of computer memory that is located either internally or externally such as, for example, random-access memory (RAM), read-only memory (ROM), compact disc read-only memory (CDROM), electro-optical memory, magneto-optical memory, erasable programmable read-only memory (EPROM), and electrically-erasable programmable read-only memory (EEPROM), Ferroelectric RAM (FRAM) or the like.

The computing device 30 may include one or more input devices, such as a keyboard, mouse, camera, touch screen and a microphone, and may also include one or more output devices such as a display screen (with three dimensional capabilities) and a speaker. The computing device 30 has a network interface in order to communicate with other components, to access and connect to network resources, to serve an application and other applications, and perform other computing applications by connecting to a network (or multiple networks) capable of carrying data including the Internet, Ethernet, plain old telephone service (POTS) line, public switch telephone network (PSTN), integrated services digital network (ISDN), digital subscriber line (DSL), coaxial cable, fiber optics, satellite, mobile, wireless (e.g. Wi-Fi, WiMAX), SS7 signaling network, fixed line, local area network, wide area network, and others, including any combination of these. Computing device 30 is operable to register and authenticate users (using a login, unique identifier, and password for example) prior to providing access to applications, a local network, network resources, other networks and network security devices. The computing device 30 may serve one user or multiple users.

Figure 4:
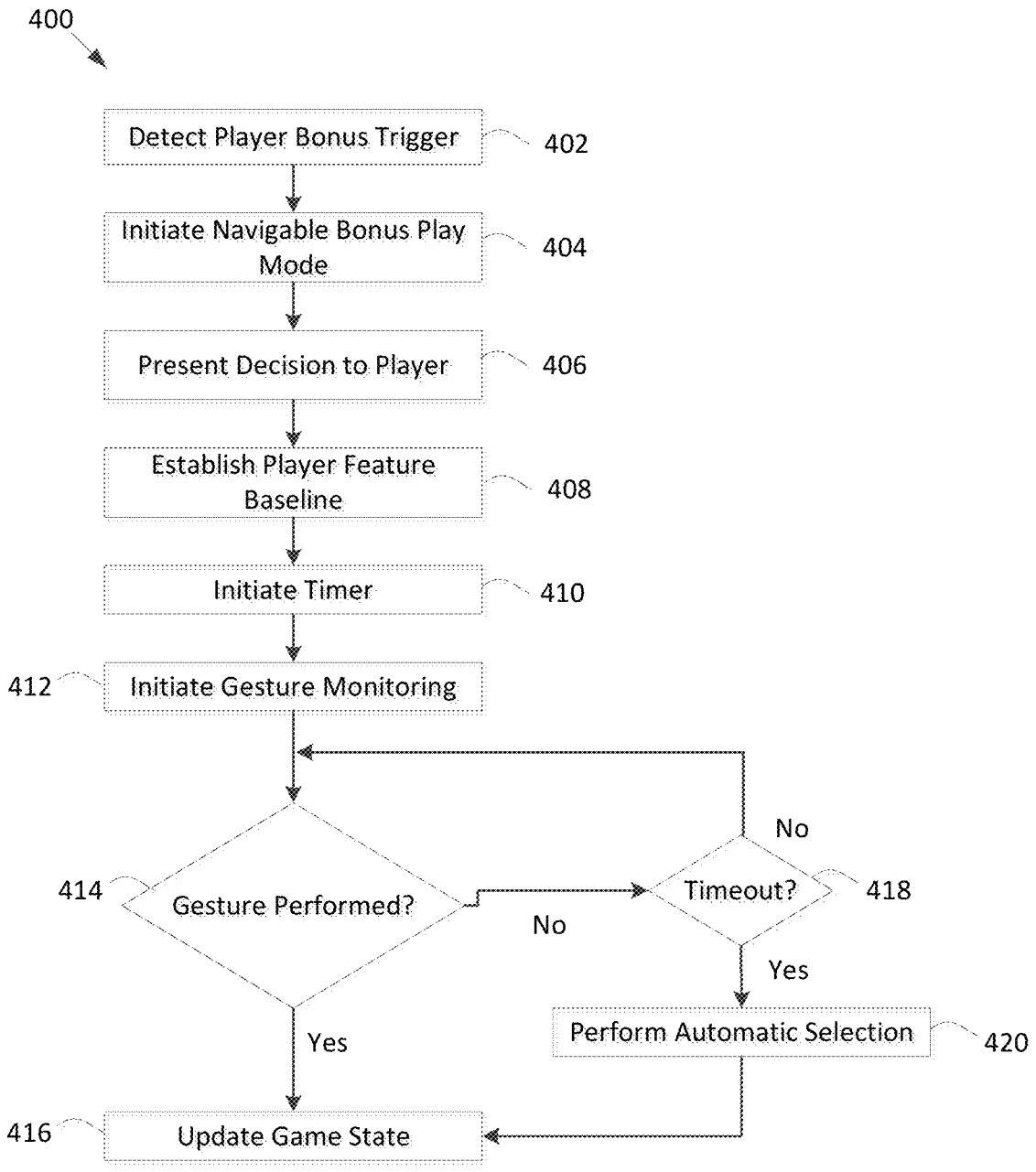
FIG. 4 is a flowchart of a method for providing gesture based navigation on a gaming system having an auto stereoscopic display.

Referring now to FIG. 4, an example method 400 will now be described. The method 400 may be performed by an EGM 10 configured for providing a game to a player, or a computing device 30 of the type described herein. More particularly, the EGM 10 or the computing device 30 may include one or more processors which may be configured to perform the method 400 or parts thereof. In at least some embodiments, the processor(s) are coupled with memory containing computer-executable instructions. These computer-executable instructions are executed by the associated processor(s) and configure the processor(s) to perform the method 400. The EGM 10 and/or computing device that is configured to perform the method 400, or a portion thereof, includes hardware components discussed herein that are necessary for performance of the method 400. These hardware components may include, for example, a camera oriented to capture movement of a player playing the game, a display configured to provide auto stereoscopic three dimensional viewing of at least a portion of the game, and the one or more processors which are coupled with the camera and display and which are configured to perform the method 400.

Figure 5:
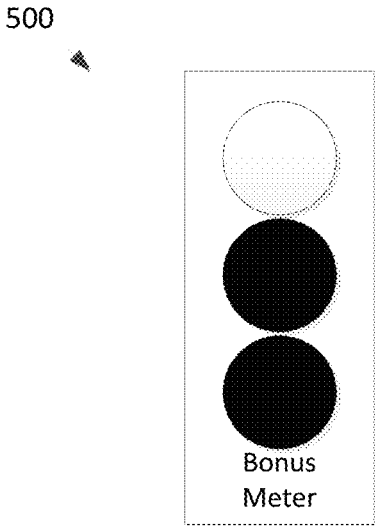
FIG. 5 is an example achievement progress indicator in accordance with example embodiments.

The method 400 may include, at operation 402, detecting a player bonus trigger. The player bonus trigger may be detected when the game being played at the EGM 10 reaches a certain state. For example, in some embodiments, the player bonus trigger occurs when a user reaches a requisite achievement or bonus level. A user's progress towards the requisite achievement or bonus level may be indicated on an achievement progress indicator 500, an example of which is displayed in FIG. 5. The achievement or bonus indicator 500 may be provided on an output device associated with the EGM, such as a display. In the example of FIG. 5, the player must progress through three achievement levels before the player bonus is triggered. Each of the three levels is represented by a ball or circle in the example, and the color of each ball or circle changes from transparent (no fill) to a color when a user achieves that level. In the example, when the user reaches the third level, the EGM detects the player bonus trigger and initiates subsequent operations of the method 400. A different number of achievement levels may trigger a bonus in other embodiments.

At operation 404, in response to detecting the player bonus trigger, the EGM 10 may initiate a bonus play mode of the game. The bonus play mode is a navigable bonus play mode in which a player navigates using gestures. More particularly, the user navigates with contactless gestures that do not require physical contact with an input mechanism of the EGM 10.

Figure 6:
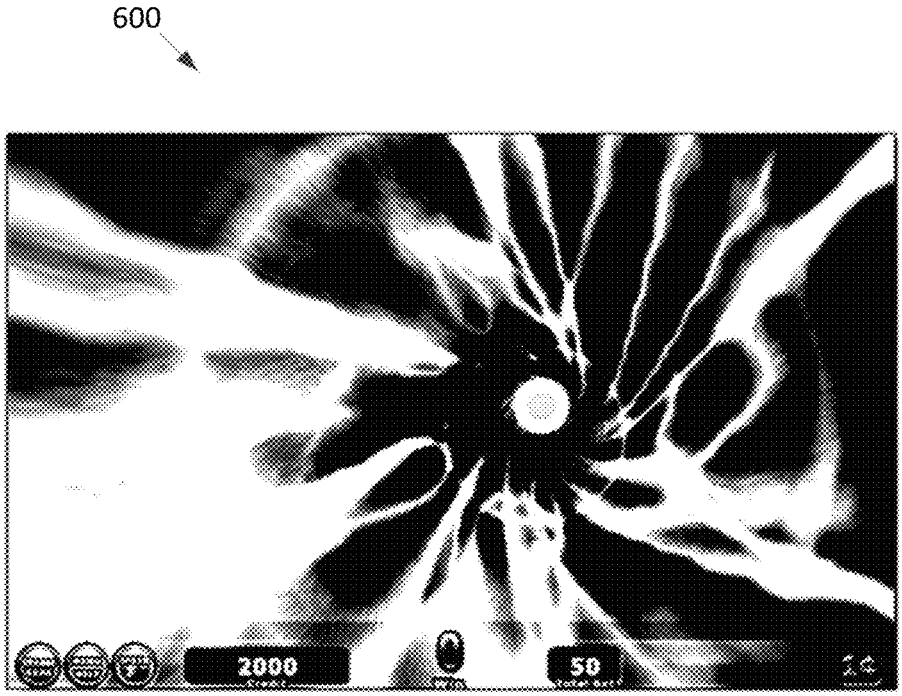
FIG. 6 is an example display screen including a tunnel in accordance with example embodiments of the present disclosure.

An example of one embodiment of the navigable bonus play mode is illustrated in FIG. 6. In this example display screen 600, a tunnel is displayed on the display. The tunnel is a tunnel that is being travelled within the game. That is, the tunnel is displayed such that the player is provided with an effect of travelling through the tunnel.

The tunnel is displayed in an auto stereoscopic mode. That is, a 3D effect is provided to the player so that the player feels more immersed in the gaming experience. The tunnel may, therefore, be referred to as a 3D tunnel. To achieve this auto stereoscopic effect, camera data from the camera is used to detect the location of the player and adjust the display so that the display is configured to provide a stereoscopic effect based on the specific location of the user's eyes. Accordingly, eye tracking features may be employed in which the EGM 10 obtains camera data from the camera, determines the player's location relative to the EGM based on the camera data, and adjusts the display based on the determined location of the player to provide auto stereoscopic 3D viewing by the player (e.g., to render the tunnel in 3D).

The camera may be a stereo camera which includes two cameras (i.e., two image sensors). To better locate the player relative to the EGM 10, depth information for the player may be determined based on the camera data from the two cameras. For example, the cameras may be placed at a known distance from one another and may be simultaneously triggered to capture an image at each camera at approximately the same time. The two images may then be analyzed to determine depth information for the player. That is, the distance from the EGM 10 and/or the cameras to the player may be determined.

In the example of FIG. 6, at the time of display the tunnel is a straight tunnel without any initial options for navigation. In this display state, the EGM 10 may not yet monitor for a gesture. That is, the EGM 10 may not analyze camera data to determine whether a gesture is performed since the gestures do not, in this state, have a corresponding action assigned during the current state of the game.

Referring again to FIG. 4, at operation 406, during a gaming session of the game, the EGM 10 presents the player with a decision. For example, the decision may be a binary decision and may be presented via the display. A binary decision is one that allows a player to select from only two possible options for proceeding.

In an embodiment, the binary decision may be presented by updating the display to indicate that the player has reached a junction or fork. For example, the rendering of the tunnel of FIG. 6 may be updated to indicate that the tunnel has reached a junction where the player is permitted to decide whether they would like to proceed through a left portion of the tunnel or through a right portion of the tunnel. In some embodiments, an output interface of the EGM 10, such as the display, may also be updated to provide the player with instructions regarding the gestures that may be performed to input a selection of one of the options. For example, the display may be updated to indicate that the player may tilt and/or move their head right to proceed down the right portion or that they may tilt and/or move their head left to proceed down the left portion.

In some embodiments, at operation 408, a player feature baseline may be established in memory. The player feature baseline indicates a starting position of the player and may be used for gesture recognition purposes. Further movement may be evaluated relative to the player feature baseline. The player feature baseline may be established in response to detecting the player bonus trigger condition at operation 402. In some embodiments, the player feature baseline may be established in response to presenting the decision at operation 406.

The player feature baseline indicates an initial location of a feature of the player's body relative to the EGM 10 (e.g., the eyes, the head, etc.). The player feature baseline may be determined based on camera data obtained from the EGM's camera. Since eye tracking is used both for gesture detection and auto stereoscopic adjustments, the location information used to adjust the display for auto stereoscopy may be the same location information that is used for gesture recognition. That is, the output of a single eye tracking component may be used for dual purposes. Accordingly, the player feature baseline may be established using eye tracking information that is also used to ensure the display is properly configured for auto stereoscopy based on the user's current location.

In some embodiments, a player feature baseline may not be established at operation 408. Instead, the player feature baseline may be preconfigured and may be the same for all players. For example, the EGM 10 may include a seat which positions all players in roughly the same position. For example, the player feature baseline may be predetermined to be a position in which the user's eyes are centered relative to the display. Thus, a center line equidistant between left and right sides of the display may be the player feature baseline and movements may be evaluated relative to this center line.

In some embodiments, the EGM 10 initiates a timer at operation 410. The timer may be initiated, for example, when the decision is presented to the player; for example, when the player reaches the junction in the tunnel.

At operation 412, the EGM 10 may begin to monitor for one or more predetermined gestures. As noted above, operation 412 may be performed in response to presenting the decision to the player at operation 406. That is, until the game reaches a state in which the gestures take meaning, there may be no monitoring for gestures. When the game reaches a state in which the gesture take meaning, the monitoring begins.

The gesture monitoring is performed based on the camera data. Accordingly, operation 412 may include, obtaining camera data, and determining a location of a feature of the player (e.g., the player's eyes or head) based on the camera data. The player locating features of the EGM 10 (e.g., eye tracking features) may be performed in the manner described above so that the location of the player's feature (e.g., the player's eyes or head) is determined relative to the EGM 10. As noted above, locating the user may assist with both auto stereoscopy and also with gesture recognition. Accordingly, the display may also be updated responsive to movement of the player to account for a change in the location of the player.

At operation 414, the EGM determines whether a movement of the player corresponds to a predetermined gesture. That is, the EGM determines whether a gesture has been performed based on the location of the feature of the player as determined at operation 412 and also based on the player feature baseline.

The predetermined gestures may include a right-wise gesture and a left-wise gesture, in some embodiments. The right-wise gesture may be a tilt of the head of the player in a right direction and the left-wise gesture may be a tilt of the head in the left direction. It will be understood that other gestures are possible in other embodiments including, for example, a raise head gesture, a lower head gesture, etc.

In determining whether the predetermined gesture has been performed, the EGM 10 may evaluate the location information determined at operation 412 relative to the player feature baseline. In some embodiments, a threshold may be used to make the determination. For example, the distance between the player's eyes at operation 412 and the player's eyes at operation 408 may be determined and compared to the threshold. The threshold is configured to account for minor movements due to breathing, etc.

If the player's feature (e.g. eyes) has travelled by at least the threshold distance in the left direction, a left-wise gesture may be determined to have been performed. If the player's feature has travelled by at least the threshold distance in the right direction, a right-wise gesture may be determined to have been performed.

The gesture recognition may consider a degree of tilt of the head of the player. That is, a gesture may be determined to be performed when the degree of tilt of the player's head exceeds a threshold.

The EGM 10 may account for variations in player distance from the EGM 10 in some embodiments. For example, depth information may be used to determine whether the gesture has been performed. For example, the threshold that is used for gesture detection may depend on the distance of the user from the EGM 10. Techniques for determining depth information are described herein.

If the EGM 10 determines that the movement of the player corresponds to a predetermined gesture then, in response, the EGM 10 updates a game state of the game based on the predetermined gesture at operation 416.

As noted above, in some embodiments, the player may be presented with a binary decision in which the player is permitted to choose from two possible options. In such embodiments, the EGM 10 may be configured to recognize two possible gestures at operation 414, such as a right-wise gesture and a left-wise gesture. Thus, at operation 414 the EGM 10 may determine that a right wise gesture has been performed and, in response, the EGM 10 selects a corresponding one of the two possible options and, at operation 416, updates the game state based on that selection. For example, at operation 416 the EGM may display, on the display, a simulation or animation in which the right portion of a tunnel is entered in response to detecting the right-wise gesture.

Similarly, at operation 414 the EGM 10 may determine that a left-wise gesture has been performed and, in response, a corresponding one of the two possible options is selected and, at operation 416, the game state is updated based on that selection. For example, at operation 416 the EGM may display, on the display, a simulation or animation in which the left portion of a tunnel is entered in response to detecting the left-wise gesture.

While the steps of initiating gesture monitoring (operation 412) and determining whether a gesture has been performed (step 414) are illustrated separately in FIG. 4, in practice, these steps may be performed as one step. For example, the EGM 10 may determining whether a gesture has been performed (i.e. perform the features of operation 414) when initiating gesture monitoring (at operation 412). Thus, features of operation 414 may be considered, in at least some embodiments, to be performed at operation 412.

During operations 414 and 416, the EGM 10 may also update the display to account for the change in the location of the player while the predetermined gesture is being performed; the auto stereoscopic effect is maintained despite the movement.

If a gesture is not detected at operation 414, in some embodiments, the EGM 10 may, at operation 418, consider whether the timer that was initiated at operation 410 has expired. If it has expired and a gesture has not been detected, then at operation 420 one of the possible options may be automatically selected by the EGM 10 without player input. For example, this selection may be random. The game state may be updated accordingly at operation 416.

However, if the timer has not expired, then the EGM 10 may continue to monitor for gestures at operation 414.

The methods and features described herein may be applied to other systems apart from the EGM 10. For example, the game may be played on a standalone video gaming machine, a gaming console, on a general purpose computer connected to the Internet, on a smart phone, or using any other type of gaming device. The video gaming system may include multiplayer gaming features.

The game may be played on a social media platform, such as Facebook™. The video gaming computer system may also connect to a one or more social media platforms, for example to include social features. For example, the video gaming computer system may enable the posting of results as part of social feeds. In some applications, no monetary award is granted for wins, such as in some on-line games. For playing on social media platforms, non-monetary credits may be used for bets and an award may comprise similar non-monetary credits that can be used for further play or to have access to bonus features of a game. All processing may be performed remotely, such as by a server, while a player interface (computer, smart phone, etc.) displays the game to the player.

The functionality described herein may also be accessed as an Internet service, for example by accessing the functions or features described from any manner of computer device, by the computer device accessing a server computer, a server farm or cloud service configured to implement said functions or features.

The above-described embodiments can be implemented in any of numerous ways. For example, the embodiments may be implemented using hardware, software or a combination thereof. When implemented in software, the software code can be executed on any suitable processor or collection of processors, whether provided in a single computer or distributed among multiple computers. Such processors may be implemented as integrated circuits, with one or more processors in an integrated circuit component. A processor may be implemented using circuitry in any suitable format.

Further, it should be appreciated that a computer may be embodied in any of a number of forms, such as a rack-mounted computer, a desktop computer, a laptop computer, or a tablet computer. Additionally, a computer may be embedded in a device not generally regarded as a computer but with suitable processing capabilities, including an EGM, A Web TV, a Personal Digital Assistant (PDA), a smart phone, a tablet or any other suitable portable or fixed electronic device.

Also, a computer may have one or more input and output devices. These devices can be used, among other things, to present a user interface. Examples of output devices that can be used to provide a user interface include printers or display screens for visual presentation of output and speakers or other sound generating devices for audible presentation of output. Examples of input devices that can be used for a user interface include keyboards and pointing devices, such as mice, touch pads, and digitizing tablets. As another example, a computer may receive input information through speech recognition or in other audible formats.

Such computers may be interconnected by one or more networks in any suitable form, including as a local area network or a wide area network, such as an enterprise network or the Internet. Such networks may be based on any suitable technology and may operate according to any suitable protocol and may include wireless networks, wired networks or fiber optic networks.

While the present disclosure generally describes an EGM which includes one or more cameras for detecting a player's location and detecting movement of the player, in at least some embodiments, the EGM may detect player location and/or movement using other sensors instead of or in addition to the camera. For example, emitting and reflecting technologies such as ultrasonic, infrared or laser emitters and receptors may be used. An array of such sensors may be provided on the EGM in some embodiments or, in other embodiments, a single sensor may be used. Similarly, in some embodiments, other indoor high-frequency technologies may be used such as frequency modulated continuous radar. By way of further example, in some embodiments, the EGM may include a seat and the seat may include pressure sensors which may be used in locating the player.

The various methods or processes outlined herein may be coded as software that is executable on one or more processors that employ any one of a variety of operating systems or platforms. Additionally, such software may be written using any of a number of suitable programming languages and/or programming or scripting tools, and also may be compiled as executable machine language code or intermediate code that is executed on a framework or virtual machine.

The gaming improvements described herein may be included in any one of a number of possible gaming systems including, for example, a computer, a mobile device such as a smart phone or tablet computer, a casino-based gaming terminal, or gaming devices of other types. In at least some embodiments, the gaming system may be connected to the Internet via a communication path such as a Local Area Network (LAN) and/or a Wide Area Network (WAN).

In this respect, the enhancements to game components may be embodied as a tangible, non-transitory computer readable storage medium (or multiple computer readable storage media) (e.g., a computer memory, one or more floppy discs, compact discs (CD), optical discs, digital video disks (DVD), magnetic tapes, flash memories, circuit configurations in Field Programmable Gate Arrays or other semiconductor devices, or other non-transitory, tangible computer-readable storage media) encoded with one or more programs that, when executed on one or more computers or other processors, perform methods that implement the various embodiments discussed above. The computer readable medium or media can be transportable, such that the program or programs stored thereon can be loaded onto one or more different computers or other processors to implement various aspects as discussed above. As used herein, the term "non-transitory computer-readable storage medium" encompasses only a computer-readable medium that can be considered to be a manufacture (i.e., article of manufacture) or a machine.

The terms "program" or "software" are used herein in a generic sense to refer to any type of computer code or set of computer-executable instructions that can be employed to program a computer or other processor to implement various aspects of the present invention as discussed above. Additionally, it should be appreciated that according to one aspect of this embodiment, one or more computer programs that when executed perform methods as described herein need not reside on a single computer or processor, but may be distributed in a modular fashion amongst a number of different computers or processors to implement various aspects.

Computer-executable instructions may be in many forms, such as program modules, executed by one or more computers or other devices. Generally, program modules include routines, programs, objects, components, data structures, etc, that perform particular tasks or implement particular abstract data types. Typically the functionality of the program modules may be combined or distributed as desired in various embodiments.

Also, data structures may be stored in computer-readable media in any suitable form. For simplicity of illustration, data structures may be shown to have fields that are related through location in the data structure. Such relationships may likewise be achieved by assigning storage for the fields with locations in a computer-readable medium that conveys relationship between the fields. However, any suitable mechanism may be used to establish a relationship between information in fields of a data structure, including through the use of pointers, tags or other mechanisms that establish relationship between data elements.

Various aspects of the present game enhancements may be used alone, in combination, or in a variety of arrangements not specifically discussed in the embodiments described in the foregoing and is therefore not limited in its application to the details and arrangement of components set forth in the foregoing description or illustrated in the drawings. For example, aspects described in one embodiment may be combined in any manner with aspects described in other embodiments. While particular embodiments have been shown and described, it will be obvious to those skilled in the art that changes and modifications may be made without departing from this invention in its broader aspects. The appended claims are to encompass within their scope all such changes and modifications.

What is claimed is:

1. An electronic gaming machine for providing a game to a player, the electronic gaming machine comprising:

a camera oriented to capture movement of the player of the game, the camera configured to generate camera data;

a display configured to provide auto stereoscopic three dimensional viewing of at least a portion of the game;

a seat for holding the player in a relatively constant position relative to the display; and at least one processor coupled with the display and the camera, the at least one processor configured to:

determine a location of the player relative to the electronic gaming machine from camera data;

adjust the display based on the determined location of the player to provide auto stereoscopic three dimensional viewing by the player;

during a gaming session of the game, present the player with a binary decision via the display, the binary decision allowing the player to select from only two possible options for proceeding;

responsive to movement of the player indicated by the camera data, update the display to account for a change in location of the player;

determine that the movement of the player corresponds to a predetermined gesture, wherein determining that the movement of the player corresponds to the predetermined gesture comprises:

determining whether a right-wise gesture has been performed; and determining whether a left-wise gesture has been performed;

update a game state of the game based on determining that the movement of the player corresponds to the predetermined gesture, wherein updating the game state of the game based on determining that the right-wise gesture has been performed comprises selecting one of the only two possible options, and wherein updating the game state of the game based on determining that the left-wise gesture has been performed comprises selecting the other one of the only two possible options;

display, on the display, a tunnel which is being travelled within the game, wherein presenting the player with the binary decision via the display comprises indicating that the player has reached a junction in the tunnel in which the tunnel splits into left and right portions, and wherein the one of the two possible options is an option to enter the right portion of the tunnel and the other one of the two possible options is an option to enter the left portion of the tunnel;

wherein the at least one processor is further configured to:

initiate a timer when the player reaches the junction in the tunnel; and upon detecting expiration of the timer, if player input has not been received selecting one of the two possible options, automatically select one of the two possible options without user input.

2. The electronic gaming machine of claim 1, wherein updating the game state of the game based on the predetermined gesture comprises:

displaying, on the display, a simulation in which the right portion of the tunnel is entered when the right-wise gesture is detected; and displaying, on the display, a simulation in which the left portion of the tunnel is entered when the left-wise gesture is detected.

3. The electronic gaming machine of claim 2, wherein the right-wise gesture is a tilt of the head of the player in a right direction and the left-wise gesture is a tilt of the head of the player in a left direction.

4. The electronic gaming machine of claim 1, wherein the one or more processors are further configured to:

detect a player bonus trigger condition and, in response, initiate a navigable bonus play mode of the game, the navigable play mode allowing the player to navigate via gestures.

5. The electronic gaming machine of claim 4, wherein the one or more processors are further configured to:

in response to detecting the player bonus trigger condition, establish a player feature baseline, the player feature baseline indicating the initial location of a feature of the player's body relative to the electronic gaming machine, and wherein the player feature baseline is used to determine that the player's movement corresponds to the predetermined gesture.

6. The electronic gaming machine of claim 5, wherein the feature of the player's body is their eyes.

7. The electronic gaming machine of claim 1, wherein the camera is a stereo camera including two cameras and wherein the at least one processor is further configured to determine depth information for the player based on the camera data from the two cameras and wherein the depth information is used to determine whether the gesture has been performed.

8. The electronic gaming machine of claim 7, wherein the depth information is used to determine a degree of tilt of a head of the player and wherein the predetermined gesture is performed when the degree of tilt of the head exceeds a predetermined threshold.

9. The electronic gaming machine of claim 1, wherein the display is updated to account for the change in location of the player while the predetermined gesture is performed.

10. A computer implemented method comprising:

determining a location of a player relative to an electronic gaming machine from camera data generated by a camera;

adjusting a display based on the determined location of the player to provide auto stereoscopic three dimensional viewing by the player;

during a gaming session of the game, presenting the player with a binary decision via the display, the binary decision allowing the player to select from only two possible options for proceeding;

responsive to movement of the player indicated by the camera data, updating the display to account for a change in location of the player;

determining that the movement of the player corresponds to a predetermined gesture, wherein determining that the movement of the player corresponds to the predetermined gesture comprises:

determining whether a right-wise gesture has been performed; and determining whether a left-wise gesture has been performed;

updating a game state of the game based on determining that the movement of the player corresponds to the predetermined gesture, wherein updating the game state of the game based on determining that the right-wise gesture has been performed comprises selecting one of the only two possible options, wherein updating the game state of the game based on determining that the left-wise gesture has been performed comprises selecting the other one of the only two possible options; and displaying, on the display, a tunnel which is being travelled within the game, wherein presenting the player with a binary decision via the display comprises indicating that the player has reached a junction in the tunnel in which the tunnel splits into left and right portions;

initiating a timer when the player reaches the junction in the tunnel; and upon detecting expiration of the timer, if player input has not been received selecting one of the only two possible options, automatically selecting one of the only two possible options without user input, and wherein the one of the only two possible options is an option to enter the right portion of the tunnel and the other one of the only two possible options is an option to enter the left portion of the tunnel.

11. The method of claim 10, wherein updating the game state of the game based on the predetermined gesture comprises:

displaying, on the display, a simulation in which the right portion of the tunnel is entered when the right-wise gesture is detected; and displaying, on the display, a simulation in which the left portion of the tunnel is entered when the left-wise gesture is detected.

12. The method of claim 11, wherein the right-wise gesture is a tilt of the head of the player in a right direction and the left-wise gesture is a tilt of the head of the player in a left direction.

13. A non-transitory computer readable medium comprising computer-executable instructions configured to cause a processor to perform a method comprising:

determining a location of a player relative to an electronic gaming machine from camera data generated by a camera;

adjusting a display based on the determined location of the player to provide auto stereoscopic three dimensional viewing by the player;

during a gaming session of the game, presenting the player with a binary decision via the display, the binary decision allowing the player to select from only two possible options for proceeding;

responsive to movement of the player indicated by the camera data, updating the display to account for a change in location of the player;

determining that the movement of the player corresponds to a predetermined gesture, wherein determining that the movement of the player corresponds to the predetermined gesture comprise:

determining whether a right-wise gesture has been performed; and determining whether a left-wise gesture has been performed;

updating a game state of the game based on determining that the movement of the player corresponds to the predetermined gesture, wherein updating the game state of the game based on determining that the right-wise gesture has been performed comprises selecting one of the only two possible options, and wherein updating the game state of the game based on determining that the left-wise gesture has been performed comprises selecting the other one of the two possible options;

detecting a player bonus trigger condition and, in response, initiating a navigable bonus play mode of the game, the navigable bonus play mode allowing the player to navigate via gestures;

in response to detecting the player bonus trigger condition, establishing a player feature baseline, the player feature baseline indicating an initial location of a player's eyes relative to the electronic gaming machine, wherein the player feature baseline is used to determine that the player's movement corresponds to the predetermined gesture;

displaying, on the display, a tunnel which is being travelled within the game, wherein presenting the player with the binary decision via the display comprises indicating that the player has reached a junction in the tunnel in which the tunnel splits into left and right portions, and wherein the one of the only two possible options is an option to enter the right portion of the tunnel and the other one of the only two possible options is an option to enter the left portion of the tunnel;

initiating a timer when the player reaches the junction in the tunnel; and upon detecting expiration of the timer, if player input has not been received selecting one of the only two possible options, automatically selecting one of the only two possible options without user input.

* * * * *